US006360973B1

(12) United States Patent
Stilli

(10) Patent No.: US 6,360,973 B1
(45) Date of Patent: Mar. 26, 2002

(54) SLOT NOZZLE FOR SPRAYING A CONTINUOUS CASTING PRODUCT WITH A COOLING LIQUID

(75) Inventor: Adrian Stilli, Bulach (CH)

(73) Assignee: Concast Standard AG, Zurich (CH)

( * ) Notice: Subject to any disclaimer, the term of this patent is extended or adjusted under 35 U.S.C. 154(b) by 0 days.

(21) Appl. No.: 09/571,106

(22) Filed: May 15, 2000

Related U.S. Application Data

(63) Continuation of application No. PCT/EP98/07069, filed on Nov. 5, 1998.

(30) Foreign Application Priority Data

Nov. 14, 1997 (CH) ..... 2639/97

(51) Int. Cl.[7] ..... B05B 1/14
(52) U.S. Cl. ..... 239/590; 239/592; 239/597
(58) Field of Search ..... 239/589, 590, 239/590.5, 592, 597, 599, 601, 398, 433, 434.5, 499, 463, 543, 429

(56) References Cited

U.S. PATENT DOCUMENTS 3,072,346 A 1/1963 Wahlin
3,428,257 A * 2/1969 Kentfiedl et al. ..... 239/601
3,759,448 A 9/1973 Watkins
4,128,206 A 12/1978 Bintner
4,708,293 A * 11/1987 Graziadio et al. ..... 239/433
4,988,043 A 1/1991 Lechler
5,011,083 A 4/1991 Matsumoto et al.
5,133,502 A 7/1992 Bendig et al.
5,921,471 A * 7/1999 Vivier et al. ..... 239/543
5,931,392 A * 8/1999 Adams ..... 239/589

FOREIGN PATENT DOCUMENTS

JP 60082157 10/1983

* cited by examiner

*Primary Examiner*—Lisa Ann Douglas
(74) *Attorney, Agent, or Firm*—Darby & Darby

(57) ABSTRACT

The spray nozzle comprises a mixing chamber into which a liquid, forming a first and a second liquid stream, can flow through two inlet openings and which comprises an outlet opening, disposed downstream, for a spray jet. A mixing chamber wall acts as a guide surface for the liquid streams and is shaped at the outlet opening such that the liquid streams meet at an angle at the outlet opening and then form the spray jet. Given an angle of impact of approximately 90°, this spraying process delivers droplets with a high level of kinetic energy and a broad uniform fan-out of the droplet paths. Large areas can therefore be uniformly sprayed with the spray nozzle from a considerable distance.

15 Claims, 3 Drawing Sheets

A
A
B
B
α
θ
4
5
6
7
7
8
9
10
12
13
16
17
30
38
39
40
45
46

L
4
5
30
$\theta_L$
C
D
7
6
8
15
16
17
45
40
38
39

SLOT NOZZLE FOR SPRAYING A CONTINUOUS CASTING PRODUCT WITH A COOLING LIQUID

This is a continuation of international application Ser. No. PCT/EP98107069 filed Nov. 5, 1998, the entire disclosure of which is incorporated herein by reference.

FIELD OF THE INVENTION

The invention relates to a spray nozzle for spraying a continuous casting product with a cooling liquid according to the preamble of claim 1.

BACKGROUND OF THE INVENTION

As is known, in a continuous casting process, in particular for the continuous casting of steel, cooling of a metal melt in a continuous casting mould results in a continuous casting product which is continuously drawn out of the mould in the form of a strand whose surface is constituted by a solidified crust and which still has a liquid core of metal melt. After leaving the mould, the strand is conveyed through a secondary cooling zone in which it is sprayed with a coolant, generally water, in order to continue removing heat from it until it has completely solidified and bring it to the temperature desired for subsequent processing.

As secondary cooling directly causes the strand to solidify or influences its solidification, the secondary cooling process and the devices required to carry it out have a decisive effect on the quality of the end products. The components used to disperse the coolant, in particular the spray nozzles, are of particular importance.

The various parameters which characterise the secondary cooling process affect the solidification of the strand in different ways and—depending on the practice—must be optimised according to different criteria.

Particularly important factors are the secondary cooling intensity, which determines the speed of the strand shell growth and which is set to be more or less "harsh" or "gengentle", depending on the practice, and the spatial distribution of the coolant application density, which should be as homogeneous as possible in order to ensure that the strand shell growth is as homogeneous as possible.

The spray nozzles used in a secondary cooling section to atomise a coolant are usually optimised with regard to the required standards of secondary cooling intensity and homogeneity of the coolant application. The kinetic energy of the cooling liquid droplets applied by spraying and, in particular, the coolant application density are in this respect determining factors for the secondary cooling intensity. The homogeneity of the coolant application density is not just determined by the homogeneity of the droplet dispersion in the spray jet produced by an individual spray nozzle. The angular distribution of the droplet paths is also relevant to the homogeneity of the coolant application density. Namely, the angular distribution determines the shape and the size of the area on a strand which can be sprayed with a spray jet. However a large number of spray nozzles are required in a secondary cooling zone in order to cover with coolant the entire area of a strand which is to be cooled. The spray jets of the individual nozzles are therefore superimposed accordingly. The angular distribution of the droplet paths of an individual spray jet is consequently a decisive factor for the homogeneity of the coolant application density when superimposing a large number of spray jets.

The known full cone nozzles deliver spray jets with a conical angular distribution of the droplet paths. Because of their conical shape, the spray jets of a plurality of full cone nozzles are unable to perfectly cover large areas for spraying; the superimposition of a plurality of spray jets results in a highly inhomogeneous coolant application density. A spray nozzle having all the features of the preamble of claim 1 is known from U.S. Pat. No. 3 072 346. This spray nozzle has a nozzle body with a mixing chamber which is rotationally symmetrical about the longitudinal axis of the nozzle body, into which chamber a liquid, forming a first and a second liquid stream, can flow through two inlet openings and which is provided with an outlet opening, disposed downstream, for a spray jet. Apart from the formation of the outlet opening, this nozzle has essential features of a known type of full cone nozzle: The two inlet openings are integrated into a guide structure for the liquid streams entering the mixing chamber such that a velocity component is imparted to the liquid streams tangentially to the mixing chamber wall as they enter the mixing chamber in addition to a velocity component in the direction of the outlet opening. This tangential velocity component causes the two liquid streams to combine after entering the mixing chamber to form one liquid stream which is directed at the outlet opening and which exhibits a vortex about the longitudinal axis of the nozzle body. Although the spray nozzle which is described in U.S. Pat. No. 3 072 346 has a round outlet opening—like a conventional full cone nozzle—, this outlet opening is widened like a funnel on the outlet side such that the emerging spray jet is distorted in the direction of the diagonals of a square. Because the outlet opening is formed in this way, the nozzle delivers a spray jet with an approximately square droplet dispersion related to a plane perpendicular to the longitudinal axis of the nozzle body.

One disadvantage of this spray nozzle is that, because of the vortex which is imposed, the form of the droplet dispersion of the spray jet is distorted to an increasing degree as the infeed pressure of the liquid increases. It is therefore impossible to comply with the standards required in terms of homogeneity of the coolant application density in a secondary cooling section with a nozzle of this kind.

A further disadvantage of this nozzle lies in the fact that its spray jet only has an approximately square droplet dispersion in one spray plane, which may not be very far away from the outlet opening, typically not more than 20 cm. Because of the short operating distance, a large number of spray nozzles of this kind are required to spray large areas with a sufficient degree of homogeneity.

BACKGROUND OF THE PRIOR ART

A flat-jet nozzle is described in U.S. Pat. No. 4 988 043. It comprises a passage for the liquid to be atomised with an outlet slot for the spray jet. The spray jet is fanned out over a wide angular range in the slot direction, whereas it hardly widens transversely to the longitudinal direction of the slot as the distance from the outlet slot increases. The quasi one-dimensional fan-out results in a flat spray jet. On account of the small extent of the spray jet transversely to the outlet slot, the process of spraying relatively large rectangular areas entails complications, whether because a large number of these flat-spray nozzles must be used or because a single flat-spray nozzle must be moved in order to cover a relatively large area with its spray jet.

OBJECT OF THE INVENTION

Taking the inadequacies of the known spray nozzles as a starting point, the object of the invention is to provide a spray nozzle which is suitable for use in a secondary cooling section of a continuous casting plant and for this purpose enables the largest possible area to be sprayed as homogeneously as possible with liquid droplets with the greatest possible kinetic energy from the greatest possible distance.

This object is achieved by a spray nozzle having the features of claim 1.

The spray nozzle according to the invention comprises a mixing chamber into which a liquid, forming a first and a second liquid stream, can flow through two inlet openings and which comprises an outlet opening, disposed downstream, for a spray jet, wherein at least one mixing chamber wall is formed as a guide surface for the liquid streams and is shaped at the outlet opening such that the liquid streams meet at an angle at or directly before the outlet opening and then form the spray jet. Because the two liquid streams are directed at the outlet opening and collide at the outlet opening, relatively large liquid droplets are produced which—related to the infeed pressure at the inlet openings—can leave the outlet opening with a relatively high level of kinetic energy. Energy losses due to vortex formation in the mixing chamber are largely prevented. The high level of kinetic energy allows an area to be sprayed from a considerable working distance. The atomisation of the two liquid streams permits a large spread of the directions of propagation of the droplets and therefore a wide fan-out of the spray jet emerging from the outlet opening. In this respect the droplets which are dispersed transversely to the direction of propagation of the liquid streams in particular play an important part in the fan-out of the spray jet. As the propagation of the liquid streams in the mixing chamber is substantially determined by the geometry of the mixing chamber, the infeed pressure can be varied over a relatively broad range without any substantial change in the fan-out of the spray jet.

In this connection the cross section of an inlet opening is basically understood to mean a section transverse to the respective liquid stream in the inlet opening, and the cross section of the outlet opening a section transverse to the spray jet.

The properties of a spray jet produced with the spray nozzle according to the invention depend substantially on the angle of impact at which the liquid streams meet at or directly before the outlet opening. An angle of impact in a range between 60° and 130°, preferably between 80° and 100°, is advantageous. This creates the conditions for producing liquid droplets which leave the outlet opening with a particularly high level of kinetic energy and form a spray jet which is distinguished by the fact that the droplets disperse in a particularly uniform manner over a particularly large solid angle about a mean direction of propagation.

The spray nozzle according to the invention has a slot as the outlet opening. If its cross-sectional area transverse to the direction of propagation of the spray jet is appropriately shaped, an outlet slot offers the possibility of spraying a rectangular area, for example. The long sides of the rectangular area for spraying are in this case substantially parallel to the direction of the longitudinal extent of the slot. The angular range over which the spray jet fans out in the direction of the longitudinal extent of the outlet slot increases with the length of the slot. This effect is due to the fact that the angular range in which droplets can leave the interaction zone of the two liquid streams at the outlet opening through the outlet slot increases in the direction of the longitudinal extent of the slot with the length f the outlet slot.

In one embodiment of the spray nozzle according to the invention the mixing chamber has a taper at the outlet opening with an opening angle at the outlet opening of between 60° and 130°, preferably between 80° and 100°. The taper forms the part of the guide surface for the liquid streams which determines the angle of impact. The taper brings together the two liquid streams at the outlet opening at an angle of impact which corresponds to the opening angle of the taper. The droplets produced at the outlet opening when the two liquid streams interact have a particularly large velocity component in the direction of the bisector of the opening angle of the taper. This direction corresponds to the mean direction of propagation of the droplets which can leave the outlet opening. Depending on its shape, the outlet opening also provides an exit for droplets whose paths are scattered over a solid angle about the mean direction of propagation. The taper may be conical, for example.

A number of further developments of the spray nozzle according to the invention have further features which, either alone and/or combined with one another, afford the condition for a homogeneous droplet dispersion over an area for spraying. In order to achieve a homogeneous droplet dispersion, it is advantageous for the outlet opening and the mixing chamber to have a common plane of symmetry. On this assumption, the two liquid streams are symmetrical with respect to the plane of symmetry. Droplets whose paths extend symmetrically to the plane of symmetry can therefore be produced. A spray nozzle whose outlet opening is formed as a slot will produce a particularly homogeneous droplet dispersion if the inlet openings in each case have a cross-sectional area of elongate shape and the directions of their longitudinal extent are in each case substantially parallel to the direction of the longitudinal extent of the outlet slot. In this case the two liquid streams are in a sense "preshaped" and adapted to the outlet slot at the inlet openings so that even at the inlet openings the lines of equal flow velocity—related to a plane transverse to the respective liquid stream—have the same or approximately the same shape as the cross-sectional area of the outlet opening (transversely to the central direction of propagation of the liquid droplets).

Another embodiment of the spray nozzle according to the invention has an outlet slot and is formed such that the mixing chamber and the outlet slot have a common plane of symmetry, wherein the longitudinal direction of the outlet slot lies in the plane of symmetry and the inlet openings are disposed on different sides of the plane of symmetry. In this case the spray jet is fanned out particularly widely in the plane of symmetry, i.e. in the longitudinal direction of the outlet slot. The droplet dispersion additionally becomes particularly homogeneous if—as in the previously discussed embodiment—the inlet openings have a cross-sectional area of elongate shape and the directions of their longitudinal extent are substantially parallel to the plane of symmetry. A particularly uniform droplet dispersion is achieved if the ratio of the sum of the two cross-sectional areas of the inlet openings to the cross-sectional area of the outlet opening is between 1.5 and 2, preferably between 1.6 and 1.8.

Another embodiment of the spray nozzle is distinguished by the fact that the mixing chamber has a taper of the above-mentioned type at the outlet opening and a cylindrical segment between the taper and the inlet openings. The cylindrical segment acts as a side wall which bounds the liquid streams. The length of the cylindrical element influences the way in which the two liquid streams intermix at the outlet opening and the efficiency with which the liquid streams are converted into droplets which leave the outlet opening unimpeded. The length of the cylindrical segment may be optimised accordingly. Additionally, it is advantageous if the inlet openings open out at the side wall of the mixing chamber. Then the energy losses due to unwanted vortex formation in the mixing chamber are particularly low and the production of the spray jet is particularly efficient.

A spray nozzle with a mixing chamber of a particularly simple construction is obtained if the inlet openings are formed between a cross bar, which connects opposite parts of the lateral boundary of the liquid streams, and the lateral boundary. If the side wall is rotationally symmetrical about an axis and the cross bar is cuboid, the cross sections of the inlet openings will be shaped like circular segments. According to the invention such inlet openings may be combined with an outlet slot whose longitudinal direction is substantially parallel to the chords of the circular segments.

The droplet dispersion in the spray jet may be influenced by defined widenings of the cross section of the outlet opening in the direction of propagation of the spray jet. One embodiment of the spray nozzle according to the invention has an outlet slot whose cross-sectional area is widened at the narrow ends in the direction of propagation of the spray jet. A particularly large fan-out of the spray jet in the longitudinal direction of the outlet slot is achieved by this means.

In another embodiment of the spray nozzle the cross section of the outlet slot is widened in the centre of the long sides of the outlet slot in the direction of propagation of the spray jet. This measure enables the proportion of droplets propagating in the direction of the mean direction of propagation to be increased.

In another embodiment of the spray nozzle according to the invention the outlet opening and the mixing chamber have a common plane of symmetry, and guide walls are provided to bound the spray jet emerging from the outlet opening.

In another embodiment of the spray nozzle according to the invention the spray nozzles are asymmetrical in that the inlet openings have different cross-sectional areas and/or the guide walls are disposed on opposite sides of the outlet opening at a different distance from the latter. These two constructional measures result on the inlet and/or outlet side in an asymmetry of the spray nozzle which has an effect on the droplet dispersion in the spray jet—even if the mixing chamber is otherwise symmetrical. If this asymmetry is suitably prominent in quantitative terms, it is possible, in comparison with a symmetrical nozzle, to move the centroid of the droplet dispersion by a predetermined distance, influence the homogeneity of the droplet dispersion and vary the shape of the area for spraying. It is possible, inter alia, to form areas for spraying with more or less curved circumferential lines—instead of a rectangular area for spraying. A spray nozzle whose mixing chamber comprises a plane of symmetry will produce a particularly homogeneous droplet dispersion on a rectangular area for spraying with a centroid which is offset with respect to the plane of symmetry if the nozzle is formed asymmetrically on the inlet and the outlet side such that the inlet opening with the smaller cross-sectional area is disposed on the same side of the plane of symmetry as the guide wall which is disposed at the greater distance from the plane of symmetry. To achieve optimum results, the distances of the guide walls from the plane of symmetry may be adapted to the asymmetry of the nozzle on the inlet side, which is characterised, for example, by the difference in size of the cross-sectional areas of the inlet openings.

A spray nozzle according to the invention which is provided with a suitable outlet slot enables, for example, a rectangular area of a width of 10 cm and a length of 50 cm to be uniformly sprayed from a distance of approximately 45 cm. Spray nozzles of this kind may advantageously be used in a secondary cooling section of a continuous casting plant to cool strands of billet or bloom format, in which case one of the spray nozzles would replace 4–6 conventional full cone nozzles and in addition make a more uniform coolant application possible. The nozzle according to the invention may be constructed with an outlet slot of a length exceeding 10 mm and a width exceeding 5 mm. Openings of this size entail little risk of the outlet slot of the spray nozzle according to the invention becoming clogged due to soiling during operation, which is quite the opposite of conventional spray nozzles. The same applies to the inlet openings, which may be approximately of the same size as the outlet openings.

The asymmetrical embodiments of the spray nozzle according to the invention are used in various ways in a continuous casting plant. In a curved mould continuous casting plant, for example, portions of a curved strand with a rectangular cross section are cooled on the different sides in the region of the secondary cooling zone by superimposing areas for spraying in the form of rectangles and segments of circular rings. Such areas can be generated with the spray nozzle according to the invention by appropriately dimensioning the components thereof. Moreover, it is usual, when casting parts in succession, to vary the cross section of the strands to be produced. This results in the problem that, after changing the cross section in a longitudinal portion of a strand path, it is not just the size of an area for spraying which has to be adapted to the changed strand geometry, but also frequently the centroid of this area. When using conventional spray nozzles, these must all be replaced by other nozzles with a different area for spraying when the cross section is changed, in which case the position of the spray nozzles must also be appropriately adapted. The same object can be achieved by means of the spray nozzle according to the invention by positioning the spray nozzles at a predetermined point and optionally using spray nozzles with differing asymmetry which take account of the change in the centroids of the areas for spraying. This procedure eliminates the complex step of re-adjusting the spray nozzle each time the cross section is changed.

BRIEF DESCRIPTION OF THE DRAWINGS

Embodiments of the spray nozzle according to the invention are illustrated in the following on the basis of diagrammatic figures, in which.

Figure 1A:
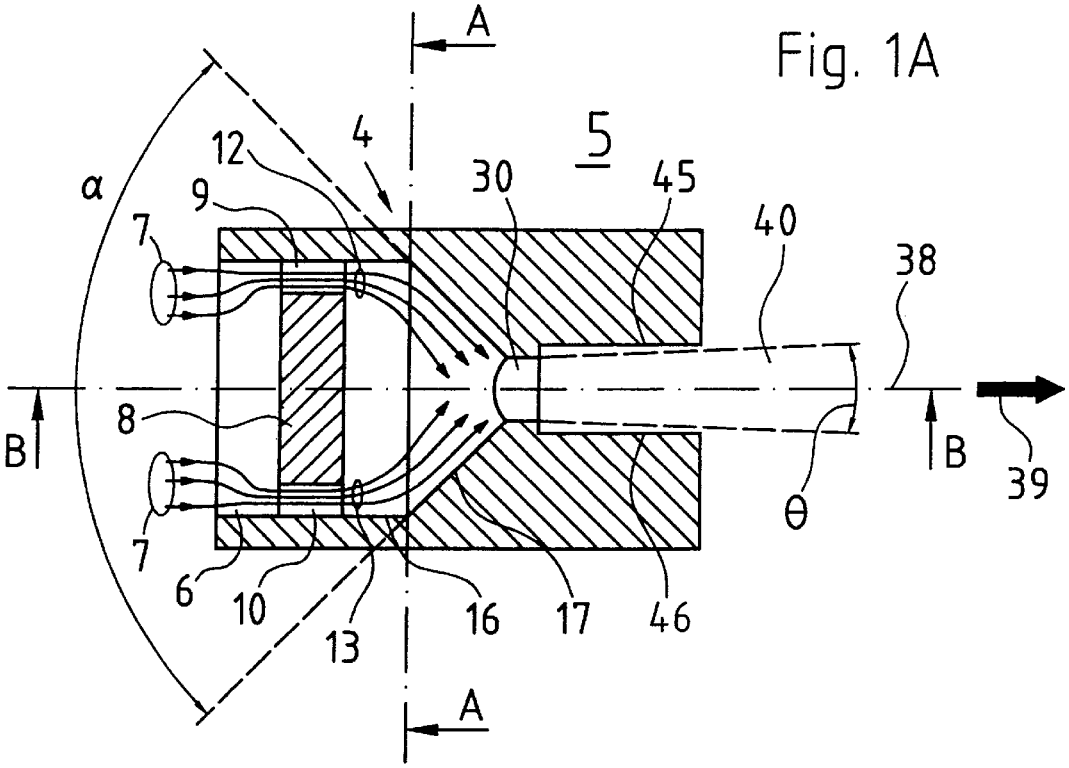
FIG. 1A is a longitudinal section through a spray nozzle.

The two spray nozzles represented in FIGS. 1A–B and 2A–C are intended for spraying a rectangular area with liquid droplets.

DETAILED DESCRIPTION OF THE INVENTION

The spray nozzle 5 represented in FIGS. 1A–B and 2A–B is symmetrical with respect to a plane 35. The spray nozzle 5 comprises a nozzle body 4 which has a cavity composed of a cylindrical portion 16 and a conical portion 17. The cylindrical part has an opening 6 through which a liquid to be atomised can be admitted at a certain pressure p and is rotationally symmetrical with respect to a longitudinal axis 38. The conical portion 17 tapers in the direction of the longitudinal axis 38 according to an opening angle a and has an outlet slot 30 for a spray jet 40 at the cone apex. The outlet slot 30 is symmetrical with respect to the plane of symmetry 35, the longitudinal direction of the cross-sectional area of the outlet slot 30 lying in the plane of symmetry 35.

Figure 1B:
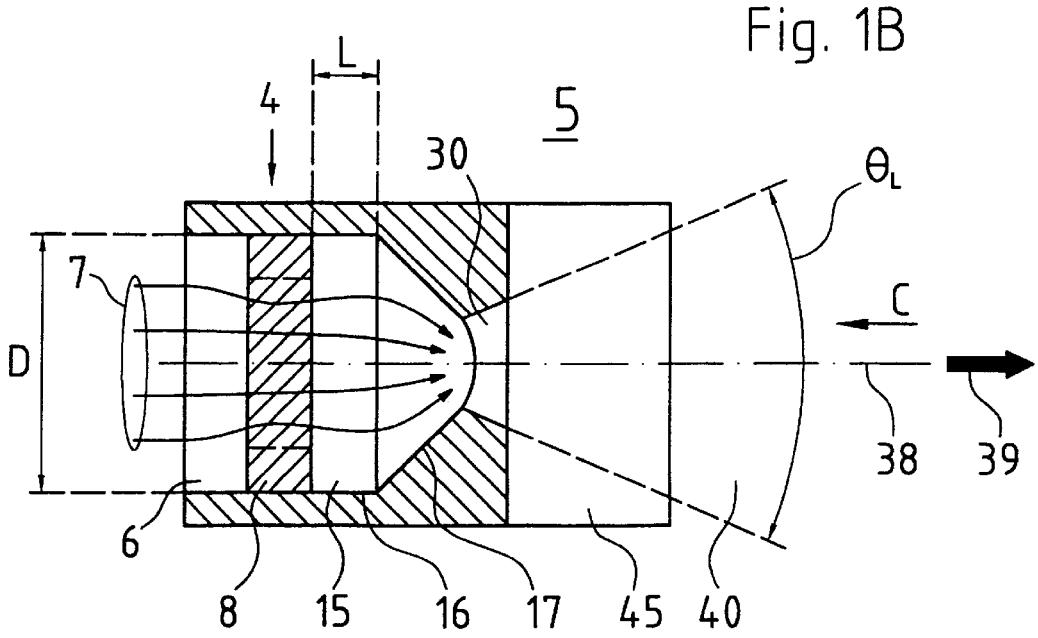
FIG. 1B is a longitudinal section through the spray nozzle in FIG. 1A along the line B—B.
Figure 2A:
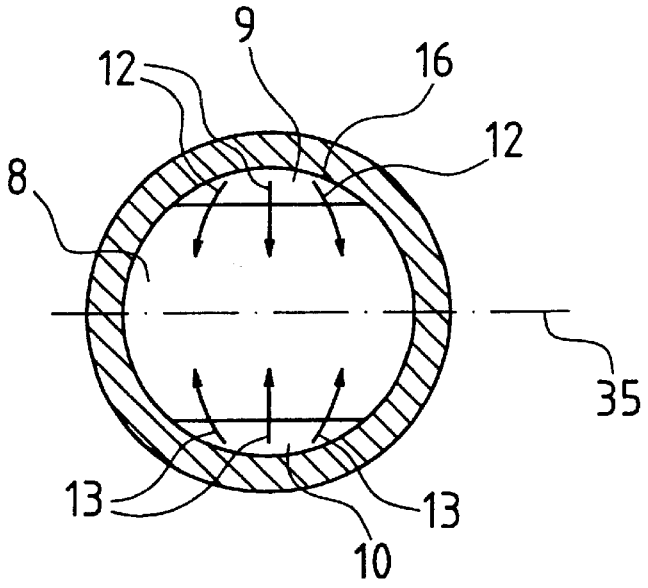
FIG. 2A is a cross section through the spray nozzle in FIG. 1A along the line A—A.
Figure 2B:
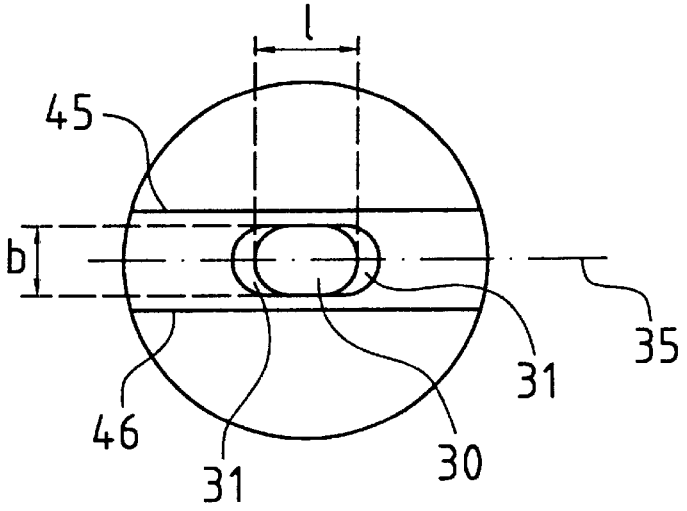
FIG. 2B is a plan view onto the spray nozzle in FIG. 1A along the arrow C in FIG. 1B and FIG. 2C corresponds to FIG. 2B, although shows a different example.

As can be seen from FIGS. 2A and 1A–B, a cross bar 8 in the cylindrical portion 16 separates a mixing chamber 15 consisting of a part of the cylindrical portion 16 and the conical portion 17 and leaves two inlet openings 9 and 10 free in the wall of the cylindrical portion 16. The cross-sectional areas of the inlet openings 9 and 10 have the shape of a circular segment and lie symmetrically on different sides of the plane of symmetry 35. The cross-sectional areas of the inlet openings 9 and 10 are of elongate shape, the directions of their longitudinal extent or the chords of the circular segments being parallel to the plane of symmetry 35.

During operation a liquid to be atomised is delivered to the spray nozzle 5 along flow lines 7 at a pressure p through the opening 6 and routed into the mixing chamber 15 through the inlet openings 9 and 10, forming a first liquid stream 12 and a second liquid stream 13. Given an appropriate choice of opening angle $\alpha$ of the conical portion 17, of the diameter D and the length L of the part of the cylindrical portion 16 which bounds the mixing chamber 15 (Figure 1B), the two liquid streams 12 and 13 are guided along the walls of the cylindrical portion 16 or conical portion 17 so as to meet at the outlet opening 30 and then form the spray jet 40.

In FIG. 1B $\Phi_L$ denotes the angle which the fan-out of the spray jet describes in the plane of symmetry, i.e. characterises the angular range over which droplets leaving the outlet opening 30 are dispersed in the plane of symmetry 35. Similarly $\Phi$ in FIG. 1A denotes the angular range over which droplets are dispersed perpendicularly to the plane of symmetry 35. As indicated in FIGS. 1A and 1B, the angle $\Phi_L$ is substantially greater than $\Phi$ in the case of the spray nozzle 5 according to the invention. In order to enable as many droplets as possible to pass through the outlet slot 30 at the narrow ends of the outlet slot 30, there is a widening 31 of the cross-sectional area of the outlet slot 30 in the direction of propagation 39 of the spray jet 40 at the narrow ends of the outlet slot 30.

Figure 2C:
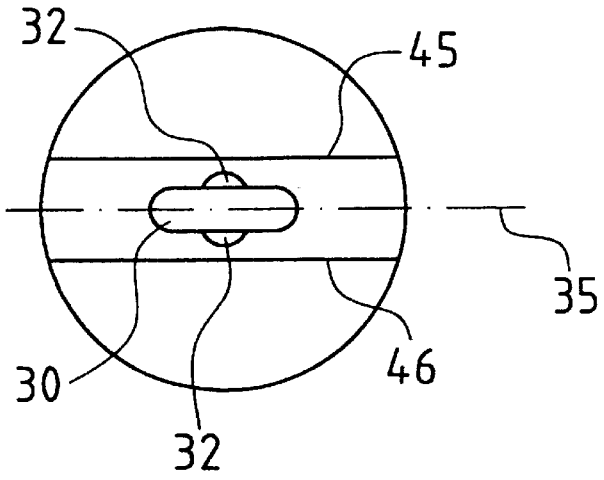

FIG. 2C indicates an alternative configuration of the outlet slot 30. The cross section of the outlet slot 30 in FIG. 2C has widenings 32 in the direction of propagation 39 of the spray jet 40 in the centre of the long sides. The widenings cause the droplets to accumulate within the plane of symmetry 35 in the direction of the longitudinal axis 38.

Guide walls 45, 46 are disposed substantially parallel to the plane of symmetry 35. Depending on the distance from the plane of symmetry 35, the guide walls act as a boundary for the spray jet 40 emerging from the outlet opening 30 and/or to protect the spray jet 40 from external disturbances, e.g. movements of the ambient air.

The opening angle $\alpha$=90° was selected in the example in FIGS. 1A and 1B. $\alpha$=90° is a preferred value with regard to the homogeneity of the droplet dispersion in the spray jet 40, the width of the fan-out of the spray jet 40 and the efficiency of the droplet production. However the spray nozzle according to the invention is also operational for 60°<$\alpha$<130°, with 80°<$\alpha$<100° being a preferred range.

The spray nozzle according to the invention as shown in FIG. 1A or 1B enables, for example, a rectangular area with dimensions of 120 mm×500 mm to be uniformly sprayed at a distance of 450 mm from the outlet opening. The angular distribution of the droplet paths is then characterised by $\Phi_L$=58° and $\Phi$=16°. Homogeneous droplet dispersions for a certain size of the mixing chamber 15 and a certain cross-sectional area of the inlet openings 9, 10 are obtained for this spray range—depending on the size of the outlet slot 30. For example, an outlet slot 30 of length 1=13.8 mm and width b=7 mm will produce a homogeneous droplet dispersion for a mixing chamber 15 of D=26 mm and L=11 mm. The optimum ratio of the sum of the two cross-sectional areas of the inlet openings 9, 10 to the cross-sectional area of the outlet opening 30 at the same time has a value of 1.7 ±0.1. On account of the highly efficient production of droplets, the spray jet 40 produces a high impact pressure of 30 kg/m$^2$ on a sprayed surface from a distance of 450 mm at a pressure p=9 bar at the entrance 6 of the spray nozzle. The operating pressure p is between 1 bar and at least 10 bar.

If the cross-sectional area of the outlet slot 30 is smaller or greater, L and D must be reduced or increased accordingly. In this respect the optimum ratio of the sum of the cross-sectional areas of the inlet opening to the cross-sectional area of the outlet opening is between 1.5 and 2, preferably between 1.6 and 1.8, and the optimum ratio of the diameter D of the cylindrical segment 16 to the length L of the cylindrical segment 16 in the mixing chamber 15 is between 2 and 3. The impact pressure at the same reference distance becomes correspondingly lower or higher.

Figure 3A:
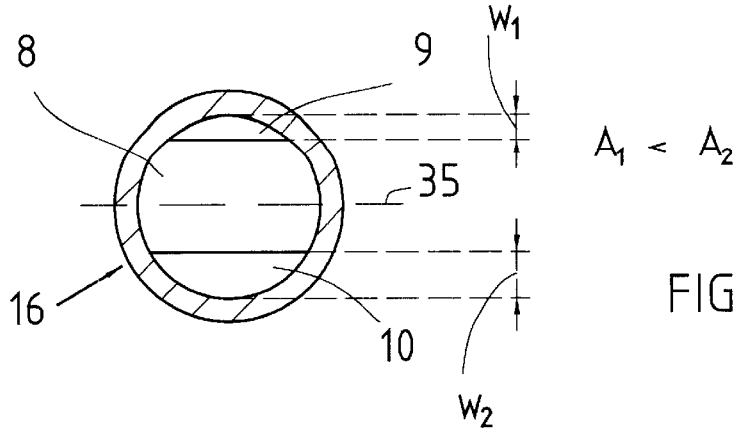
FIG. 3A corresponds to FIG. 2A, although has inlet openings of a different size.
Figure 3B:
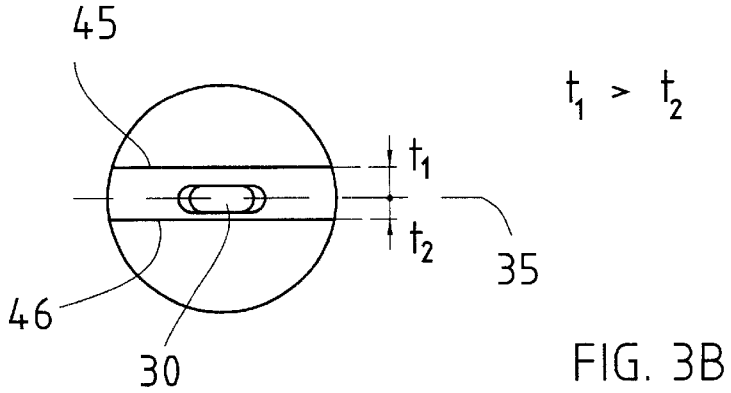
FIG. 3B corresponds to FIG. 2B, although has guide surfaces on the outlet side which are at a different distance from the outlet opening.
Figure 3C:
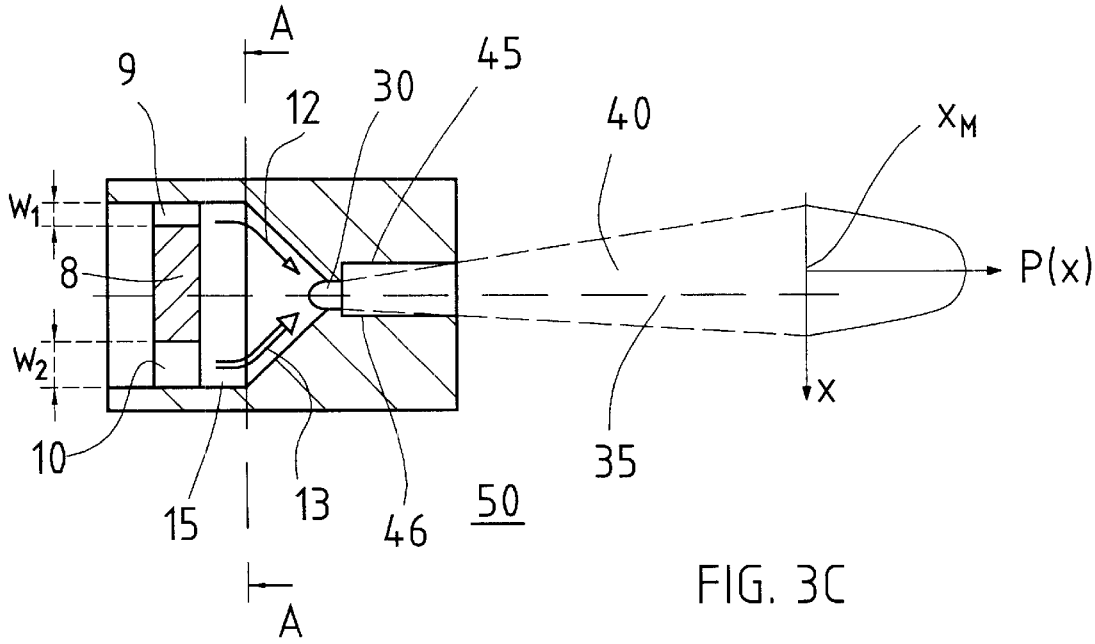
FIG. 3C corresponds to FIG. 1A, although is modified according to FIGS. 3A and 3B.

FIGS. 3A–C represent an asymmetrical spray nozzle 50, which may be considered as a modification of the 25 previously-described spray nozzle 5 distinguished by the plane of symmetry 35. The asymmetrical spray nozzle 50 differs from the symmetrical spray nozzle 5 in that the cross bar 8 is offset with respect to the plane of symmetry 35, the inlet openings 9 and 10 consequently form circular segments with different areas $A_1$ and $A_2$ and the guide surfaces 45 and 46 are at different distances $t_1$ and $t_2$ from the centre of the outlet opening 30. Where the asymmetrical spray nozzle 50 is concerned, $A_1<A_2$ and $t_1$, $>t_2$, i.e. of the inlet openings 9 and 10, the one with the smaller cross-sectional area is disposed on the same side of the plane of symmetry 35 as the guide wall of the two guide walls 45 and 46 which is furthest away from the plane of symmetry 35. Because of the different shaping or dimensioning of the inlet openings 9 and 10, the liquid streams 12 and 13 transport different quantities of liquid (indicated in FIG. 3C by arrows with a line thickness corresponding to the quantity of liquid). As the liquid streams 12 and 13 are not symmetrical with respect to the lane of symmetry 35 in this configuration and droplets with an asymmetrical momentum distribution are consequently produced when the liquid streams meet, depending on the distance x from the plane of symmetry 35, the spray jet 40 is characterised by a droplet dispersion P(x) whose maximum is located at a distance $x_M$ from the plane of symmetry 35 on the side opposite the inlet opening 10. The distance $x_M$ may be varied by a suitable presetting of the widths $w_1$ and $w_2$ of the inlet openings 9 and 10. A rectangular spraying area with a homogeneous droplet distribution P(x) in a plane perpendicular to the plane of symmetry 35 will result if the distances $t_1$ and $t_2$ of the guide walls 45 and 46 are appropriately adapted. If the distances $t_1$ and $t_2$ are not optimally adapted to $w_1$ and $w_2$, this may result in a spraying area which is not rectangular, instead having the shape of a segment of a circular ring, for example.

What is claimed is:

1. A spray nozzle for spraying a continuous casting product with a cooling liquid, including a mixing chamber; a first inlet opening and a second inlet opening for injecting the liquid into the mixing chamber thereby forming a first liquid stream and a second liquid stream in the mixing chamber; an outlet slot, disposed downstream, for a spray jet, wherein at least one mixing chamber wall is formed as a guide surface for the liquid streams and is shaped at the outlet slot such that the liquid streams meet at an angle, which is between 60° to and 130°, at the outlet slot and then forms the spray jet;

wherein the mixing chamber has a taper at the outlet slot with an opening angle at the outlet slot of between 60° and 130°, and the taper forms a part of the guide surface, and the outlet slot and the mixing chamber have a common plane of symmetry.

2. A spray nozzle according to claim 1, wherein the mixing chamber has a cylindrical segment between the taper and the inlet openings.

3. A spray nozzle according to claim 2, wherein the ratio of the diameter of the cylindrical segment to the length of the cylindrical segment is between 2 and 3.

4. A spray nozzle according to claim 1, wherein the inlet opening in each case have a cross-sectional area of elongate shape and the directions of their longitudinal extent are in each case substantially parallel to the direction of the longitudinal extent of the outlet slot.

5. A spray nozzle according to claim 1, wherein the mixing chamber has a side wall which bounds the liquid streams at the side, and the inlet openings each opens into the mixing chamber.

6. A spray nozzle according to claim 5, wherein the inlet openings are formed between the side wall and a cross bar.

7. A spray nozzle according to claim 1, wherein the ratio of the sum of the two cross-sectional areas of the inlet openings to the cross-sectional area of the outlet slot is between 1.5 and 2.

8. A spray nozzle according to claim 1, wherein the longitudinal direction of the outlet slot lies in a plane of symmetry, and the inlet openings are disposed on different sides of the plane of symmetry.

9. A spray nozzle according to claim 1, wherein the cross section of the inlet openings is shaped like a circular segment.

10. A spray nozzle according to claim 1, wherein the cross-sectional, area of the outlet slot has a widening at the narrow ends in the direction of propagation of the spray jet.

11. A spray nozzle according to claim 1, wherein the cross section of the outlet slot has a widening in the center of the long sides of the outlet slot in the direction of propagation of the spray jet.

12. A spray nozzle according to claim 1, wherein guide walls are disposed in the direction of the longitudinal extent of the outlet slot to bound the spray jet emerging from the outlet slot.

13. A spray nozzle according to claim 12, wherein the guide walls are disposed on opposite sides of the outlet slot at different distances from the outlet slot.

14. A spray nozzle according to claim 13, wherein the inlet openings have different cross-sectional areas, the inlet opening with the smaller cross-sectional area is disposed on the same side of the plane of symmetry as the guide wall which is disposed at the greater distance from the plane of symmetry.

15. A spray nozzle according to claim 1, wherein the inlet openings have different cross-sectional areas.

* * * * *

UNITED STATES PATENT AND TRADEMARK OFFICE

CERTIFICATE OF CORRECTION

PATENT NO. : 6,360,973 B1
DATED : March 26, 2002
INVENTOR(S) : Adrian Stilli

It is certified that error appears in the above-identified patent and that said Letters Patent is hereby corrected as shown below:

Title page,
Item [30], Foreign Application Priority Data, delete "Nov. 14, 1997 (CH)……...2639/97" and add -- Nov. 14, 1997 (CH)…….26391/97 --.

Signed and Sealed this

Fifteenth Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,360,973 B1
DATED : March 26, 2002
INVENTOR(S) : Adrian Stilli

It is certified that error appears in the above-identified patent and that said Letters Patent is hereby corrected as shown below:

Title page,
Item [30], Foreign Application Priority Data, "Nov. 14, 1997 (CH) …….2639/97" (as deleted by Certificate of Correction issued October 15, 2002) should be reinstated.

Signed and Sealed this

Fifth Day of October, 2004

JON W. DUDAS
*Director of the United States Patent and Trademark Office*